US007221245B2

(12) United States Patent
Tanbakuchi et al.

(10) Patent No.: US 7,221,245 B2
(45) Date of Patent: May 22, 2007

(54) BALANCED MICROWAVE CABLE ADAPTOR HAVING A CONNECTOR INTERFACE SECURED BY A SLIDABLE NUT

(75) Inventors: Hassan Tanbakuchi, Santa Rosa, CA (US); Paul E. Cassanego, Santa Rosa, CA (US); Kenneth H. Wong, Santa Rosa, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 85 days.

(21) Appl. No.: 11/065,020

(22) Filed: Feb. 23, 2005

(65) Prior Publication Data

US 2005/0140459 A1 Jun. 30, 2005

Related U.S. Application Data

(63) Continuation-in-part of application No. 10/309,543, filed on Dec. 4, 2002, now Pat. No. 6,937,109.

(51) Int. Cl.
*H01P 1/04* (2006.01)

(52) U.S. Cl. ..... 333/260; 333/4; 439/578; 174/88 C

(58) Field of Classification Search ..... 333/4, 333/5, 260; 174/88 C; 439/578
See application file for complete search history.

(56) References Cited

U.S. PATENT DOCUMENTS

| | | | | |
|---|---|---|---|---|
| 2,379,942 | A * | 7/1945 | Webber | 439/89 |
| 2,449,073 | A * | 9/1948 | Johannesen | 174/21 C |
| 2,719,279 | A * | 9/1955 | Muckler | 439/533 |
| 2,937,228 | A * | 5/1960 | Robinson | 174/88 C |
| 3,551,858 | A | 12/1970 | Cielo | |
| 4,215,326 | A | 7/1980 | Hollyday | |
| 4,296,390 | A | 10/1981 | Vanderheyden et al. | |
| 2004/0108914 | A1 | 6/2004 | Tanbakuchi et al. | |

FOREIGN PATENT DOCUMENTS

| | | |
|---|---|---|
| EP | 0 190 843 | 8/1986 |
| GB | 2208259 | 3/1989 |

OTHER PUBLICATIONS

TRL Calibration Guide, Agilent 85052C Precision Calibration Kit, Agilent Technologies, Inc., Part No. 85052-90059 (Oct. 2001).
Data Sheet; Connector Guage Kit; Precision 7mm Co-planar Connectors (APC-7); Maury Microwave Corporation (Jan. 4, 2002).
Radiall, S.A., Leaflet entitled "The Multi-Port Connectors" (2002).
Amphenol Corporation Catalog, "Twinaxial," pp. 123-125 (2002).
GB Search Report Under Section 17 dated Apr. 26, 2006.

* cited by examiner

*Primary Examiner*—Benny Lee

(57) ABSTRACT

An adaptor includes a connector interface having a first coaxial structure with a first center pin configured to be coupled to a first center conductor of a first coaxial transmission line and a second coaxial structure with a second center pin configured to be coupled to a second center conductor of a second coaxial transmission line. A nut surrounds the first coaxial structure and the second coaxial structure.

15 Claims, 5 Drawing Sheets

BALANCED MICROWAVE CABLE ADAPTOR HAVING A CONNECTOR INTERFACE SECURED BY A SLIDABLE NUT

CROSS-REFERENCE TO RELATED APPLICATIONS

This patent application is a continuation-in-part of U.S. patent application Ser. No. 10/309,543, entitled BALANCED MICROWAVE CONNECTOR AND TRANSITION, filed Dec. 4, 2002 by Hassan Tanbakuchi, Paul E. Cassanego, and Kenneth H. Wong, which issued on Aug. 30, 2005 as U.S. Pat. No. 6,937,109 B2.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to high-frequency components and more particularly to a cable having a connector interface with two coaxial microwave structures.

BACKGROUND OF THE INVENTION

High-frequency connectors are used in cable ends, package feedthroughs, adaptors, probes, and similar applications. Connector interfaces typically provide a single coaxial structure that maintains the characteristic impedance of the transmission line through the connector. Balanced techniques, which use two high-frequency transmission lines, are desirable in some applications because they can provide a larger signal and superior noise immunity compared to unbalanced techniques, but generally involve making twice as many connections to a device or circuit.

Balanced cables are presently available with two coaxial cables that are joined within a single cable housing for most of the length of the cable, but these balanced cables are basically two coaxial cables with regular coaxial cable ends. Joining the cables together for most of their length avoids some inter-cable movement and keeps the cables reasonably balanced, but connecting the cables to a device requires connecting each of the cable ends causing relative movement between the cable ends that can introduce measurement error or uncertainty. Other presently available types of balanced cables extend center conductors of two coaxial transmission lines through a single connector without maintaining the coaxial structures of the transmission lines through the connector. While these types of balanced cables are typically used at low frequencies (e.g. below 200 MHz), they are not well suited for use in high-frequency applications.

BRIEF SUMMARY OF THE INVENTION

An adaptor includes a connector interface having a first coaxial structure with a first center pin configured to be coupled to a first center conductor of a first coaxial transmission line and a second coaxial structure with a second center pin configured to be coupled to a second center conductor of a second coaxial transmission line. A nut surrounds the first coaxial structure and the second coaxial structure.

DETAILED DESCRIPTION OF THE INVENTION

I. Introduction

A connector interface constructed according to the embodiments of the present invention includes two coaxial structures within a single connector provides superior balanced high-frequency performance and allows closer pin spacing compared to conventional coaxial connectors. Balanced high-frequency techniques are used in a variety of applications, such as digital communication analysis, digital oscilloscopes, wafer testing, differential vector network analysis, or to run separate signals side-by-side, such as a test signal with a clock signal or a test signal with a reference signal. Conventional balanced measurement techniques use a pair of connectors. If conventional connectors are used to connect coaxial transmission lines to an electronic circuit, such as a printed wiring board ("PWB"), differential probe, integrated circuit, or thick-or thin-film hybrid microcircuit, the connectors are spaced far apart, to allow for connecting and disconnecting each connector. It is difficult to achieve high-frequency balanced circuits with the spacing resulting from paired conventional connectors.

II. Exemplary Connectors

Figure 1A:
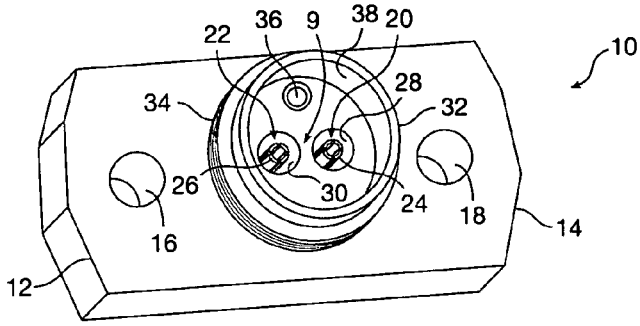
FIG. 1A is a simplified perspective view of a connector interface according to an embodiment of the present invention incorporated in a package launch.

FIG. 1A is a simplified perspective view of a connector interface 9 according to an embodiment of the present invention incorporated in a package launch 10. The package launch includes mounting flanges 12, 14 with through holes 16, 18 for attaching the package launch to a package of an electronic device. Two coaxial structures 20, 22 are incorporated into the connector interface. The coaxial structures typically correspond to a connector standard, such as 1.0 mm, 1.85 mm, 2.4 mm, SMA, or other connector standard. Alternatively, the coaxial structures are not in accordance with any connector standard. It is not necessary that each coaxial structure within a connector interface have the same dimensions. In one example, each coaxial structure conforms to a 1.85 mm connector standard, with center pins 24, 26 supported within the conductive outer walls 28, 30 of the coaxial structures. The center pins are male-female type, but alternatively are overlapping or butt-contact center pins, which are known as sexless connectors.

The 1.85 mm connector standard provides high-frequency performance up to 70 GHz. The center pins have compliant fingers to accept a mating center conductor (see FIG. 1B, ref. nums. 46, 48). Connectors with center pins that accept center conductors, such as the differential package launch interface illustrated in FIG. 1A, are typically referred to as "female" connectors, and the corresponding connectors with protruding center conductors or pins are referred to as "male" connectors.

A barrel 32 includes threads 34 for securing a nut captivated on the mating part (see FIG. 1C, ref. num. 76) configured to screw onto the threads. In one alternative, the nut is on the barrel and the mating connector part is threaded. In another alternative, a bayonet-type, snap-on, or other mechanical coupling technique is used. An alignment feature 36 polarizes the connector interface and aligns the center conductors of the mating parts, as well as prevents twisting of one part relative to the other when the nut is tightened. The alignment feature is a countersunk hole that is configured to accept an alignment pin (see FIG. 1B, ref. num. 54), which is typically rounded or chamfered to facilitate insertion into the hole. In a particular embodiment, each half of a connector interface pair includes a pin and an alignment hole corresponding to the alignment hole and pin on the mating part. In another embodiment, one half of a connector interface pair has two pins, and the mating part has two alignment holes. The pins and holes may be offset or of different diameter to further prevent misalignment. Polarization of the connector interface insures that the correct coaxial structures are coupled to their respective transmission lines on the mating part. Other alignment features, such as a key and slot outside the barrel of the connector interface are alternatively used.

It is generally desirable that the alignment pin contacts the alignment feature before the center pins contact the center conductors. The mating part also has a rim that contacts the inner diameter 38 of the connector interface. The rim works in conjunction with the alignment pin to guide the center conductors into the center pins without twisting the center conductors with respect to the center pins. Twisting might deform the center conductors and/or center pins, and might even break fingers off of the center pins. Even if the center conductors and center pins are not permanently bent, misalignment or twisting of the connectors can degrade measurement accuracy. The center pins and center conductors of conventional connectors having radial symmetry are typically not deformed or broken by mere twisting between the mating connector parts. To ensure that the outer conductors of the connectors make electrical contact around the 1.85 mm bores, the surface around the bores of the male connector may be raised slightly to minimize the impact of surface flatness.

Figure 1B:
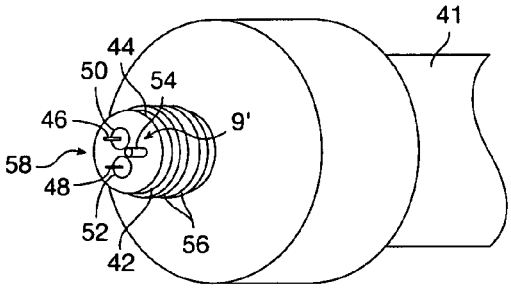
FIG. 1B is a simplified perspective view of a connector interface according to another embodiment of the present invention incorporated in the end of a balanced cable.

FIG. 1B is a simplified perspective view of a connector interface 9, according to another embodiment of the present invention incorporated in the end of a balanced cable 41. This connector interface 9, is configured to mate with the connector interface 9 illustrated in FIG. 1A. The barrel 42 of the connector interface includes a rim 44 that is partially inserted into the inner diameter (see FIG. 1A, ref. num. 38) before the center conductors 46, 48 of the coaxial transmission lines 50, 52 contact the center pins of the connector interface on the package launch. A pin 54 is also partially inserted into the alignment feature (see FIG. 1A, ref. num. 36) before the center conductors contact the center pins. A nut (not shown in FIG. 1B for clarity of illustration) is retained by ridges 56 on the connector end, allowing the nut to spin as it is tightened onto the threads of the package launch to secure the face 58 of the connector interface on the balanced cable against the opposing face of the connector interface on the package launch. To facilitate the proper orientation of the alignment pin to the alignment feature, the coupling nut or mechanism may be configured to be retractable so that the alignment pin is visible and can be oriented to align with the alignment features.

Figure 1D:
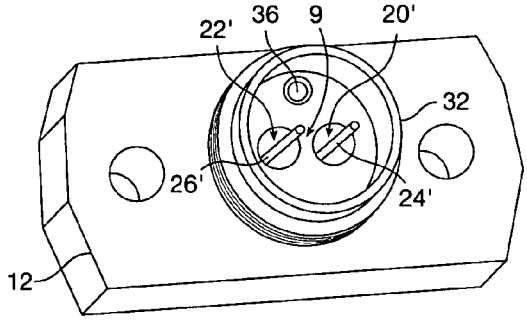
FIG. 1D is a simplified perspective view of a connector interface according to another embodiment of the present invention incorporated in a package launch.
Figure 1C:
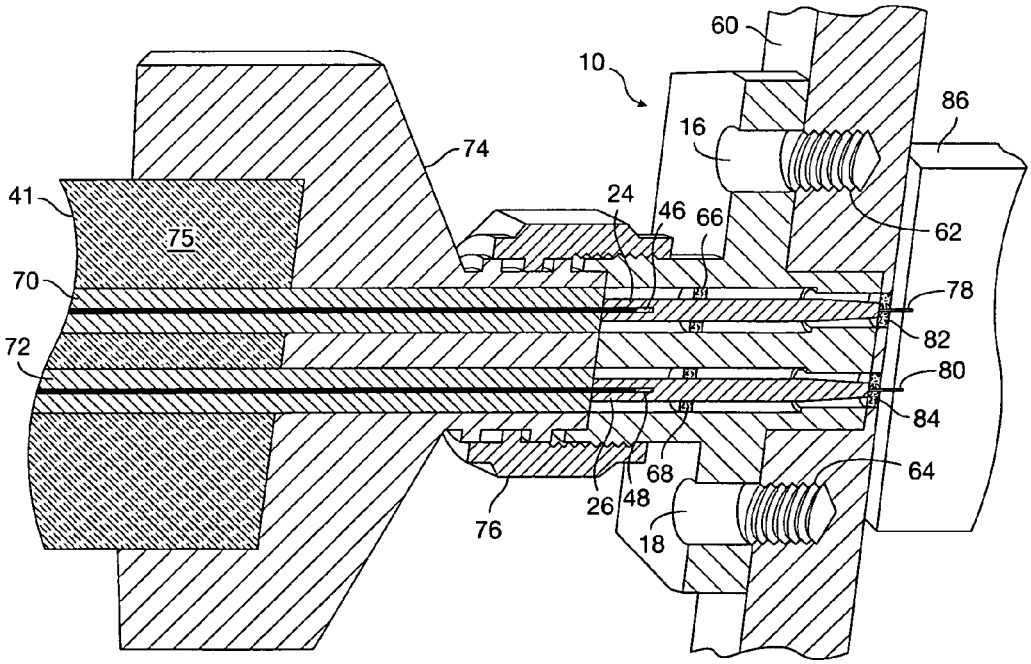
FIG. 1C shows a cross section of the connector interface of FIG. 1A connected to the connector interface of FIG. 1B.

FIG. 1C shows a cross section of the connector interface of FIG. 1A connected to the connector interface of FIG. 1B. The package launch 10 is shown mounted on a circuit package 60. The screws that would typically be inserted through the mounting holes 16, 18 of the package launch and screwed into the screw holes 62, 64 of the circuit package are omitted for clarity of illustration.

The center pins 24, 26 of the connector interface of the package launch 10 are supported with dielectric stand-offs 66, 68 inside the coaxial structures and accept the center conductors 46, 48 of the two coaxial cables 70, 72 in the balanced cable 41. A cable end 74 is machined from metal and securely holds the ends of the coaxial cables. The coaxial cables may be semi-rigid coaxial cables that include center conductors separated from outer conductors by dielectric spacers. The balanced cable is filled with compliant polymer 75 to support the coaxial cables and generally maintain their relationship to each other as the balanced cable is bent. A nut 76 on the cable end 74 engages the threads on the package launch 10 to securely connect the mating connector interfaces. Alternatively, the nut is provided on the package launch and the cable end is threaded. Similarly, the package launch is alternatively a male connector, and the cable end is a female connector. Alternatively, the cable end may be connected to a twin coaxial structure such that the other end of the coaxial structure are made with the connector features of FIG. 1B.

In a particular embodiment, the nut 76 is a slidable nut that may be slid backwards (retracted) to expose the center conductors 46, 48 of the two coaxial cables 70, 72 in the balanced cable 41 and an alignment pin (not shown, see FIG. 1B, ref. num. 54). Providing a slidable nut is particularly desirable with connector interfaces having two coaxial structures because it allows accurate, concurrent alignment of the alignment pin and of the two coaxial structures. Viewing conventional connector interfaces having a single coaxial structure as they are brought together is not critical because there is not a pin or other structure to align with a mating feature. Generally, conventional single-coaxial connectors may be rotated about the center axis.

Feedthrough pins 78, 80 extend from the opposite (distal) end of the package launch through glass feedthroughs 82, 84 into the interior of the circuit package 60. The feedthrough pins may then be electrically connected to an electronic circuit 86. The feedthrough pins include a glass-to-metal seal, which seals the circuit package. Alternatively, the feedthrough pins extend into the package without a glass-to-metal seal.

FIG. 1D is a simplified perspective view of a connector interface 9 according to another embodiment of the present invention incorporated in a package launch. A first coaxial structure 20' includes a male center conductor 24' and a second coaxial structure 22' includes a second male center conductor 26. The connector interface 9 also includes the mounting flange 12, barrel 32 and alignment feature 36, as described above in reference to FIG. 1A.

III. Balanced VNA Measurements and Adaptors

Figure 2A:
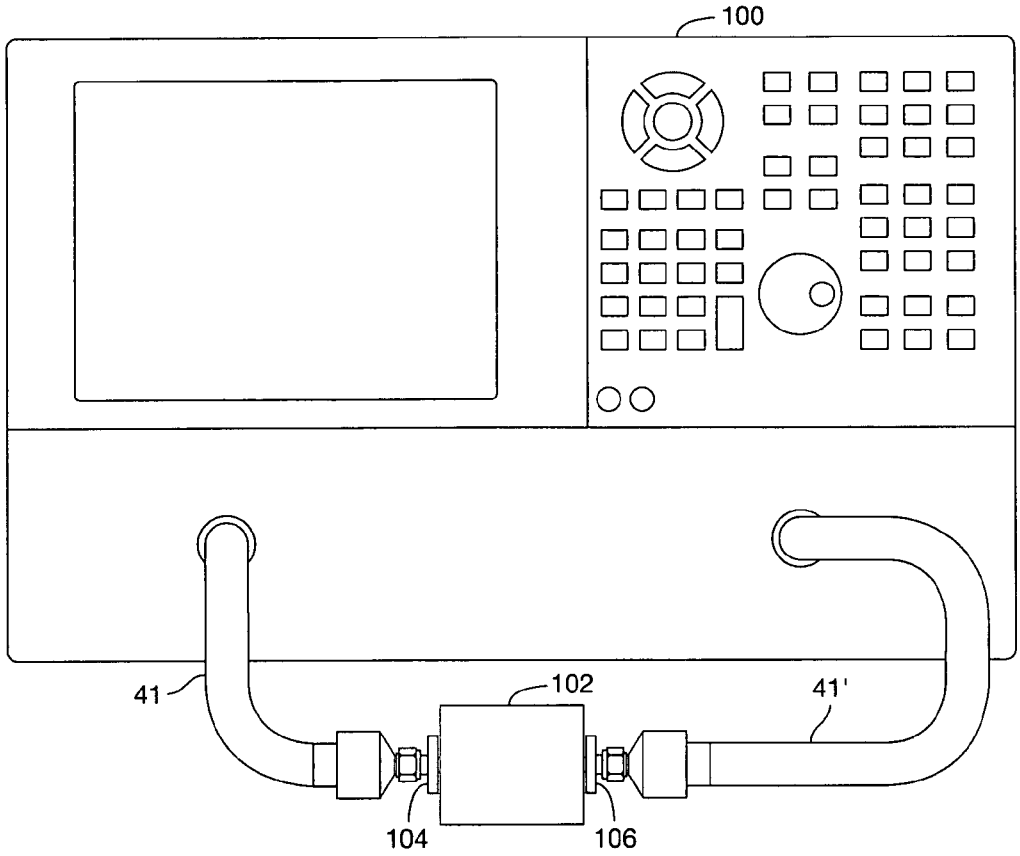
FIG. 2A shows an electronic device with connector interfaces according to the present invention coupled to a vector network analyzer with balanced cables.

FIG. 2A shows an electronic device 102, commonly referred to as a device under test ("DUT"), with connector interfaces 104, 106 according to the present invention coupled to a vector network analyzer ("VNA") 100 with balanced cables 41, 41'. Each balanced cable contains two coaxial transmission lines and has a cable end with a connector interface according to the present invention that is connected to the corresponding connector interface of the electronic device.

Figure 2B:
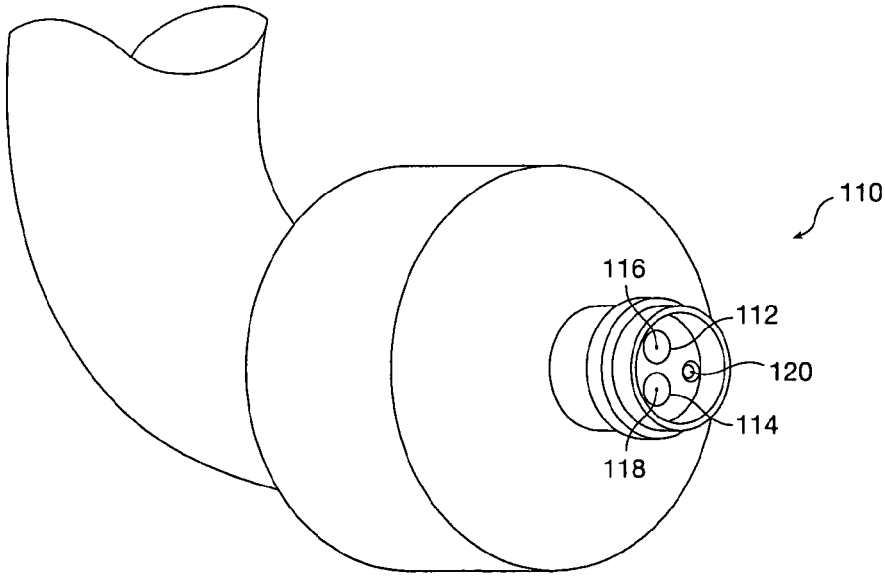
FIG. 2B is a simplified perspective view of a connector interface incorporated in the end of a balanced cable according to an alternative embodiment of the present invention.

FIG. 2B is a simplified perspective view of a connector interface 110 incorporated in the end of a balanced cable according to an alternative embodiment of the present invention. The balanced cable is similar to the balanced cable illustrated in FIG. 11B; however, the connector interface is a female connector interface, similar to the female connector interface illustrated in FIG. 1A, rather than the male connector interface illustrated in FIG. 11B. The connector interface has two coaxial structures 112, 114 with center pins 116, 118 that accept center conductors of the mating connector part. An alignment feature 36 keeps the connector interface from twisting when connecting or disconnecting the mating part.

Figure 3A:
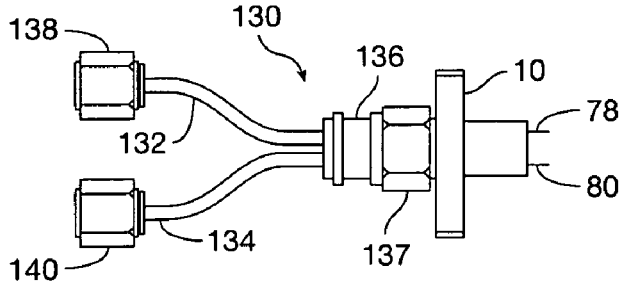
FIG. 3A shows a connector interface according to an embodiment of the present invention incorporated into an adaptor assembly connected to a package launch.

FIG. 3A shows an adaptor assembly 130 with a connector interface 136 according to an embodiment of the present invention connected to a package launch 10. The adaptor assembly joins two coaxial cables 132, 134, such as semi-rigid coaxial cable, into the connector interface 136. A slidable nut 137 on the package launch engages threads on the connector interface 136 of the adapter assembly 130. The opposite ends of the coaxial cables have conventional connector ends 138, 140, such as 1.85 mm or 2.4 mm cable ends.

The package launch provides differential feedthrough pins 78, 80 that are about 3 mm apart. Providing differential feedthrough pins in such close proximity facilitates electrical connection to PCBs, microcircuits, or integrated circuits ("ICs") and enables measurement of common-mode and differential-mode signals. The connector interfaces on the adaptor and the mating connector interface on the package launch are referred to as "differential connectors" for purposes of discussion. In a particular embodiment, a differential connector is used with a wafer probe to provide accurate, high-frequency measurements of unpackaged ICs. It is desirable that the feedthrough pins are not more than 5 mm apart (center-to-center) to facilitate the transition from the connector interface to a balanced device or circuit. In particular, it is desirable to avoid having to change the spacing between balanced transmission lines on a circuit to accommodate pin spacing. Balanced transmission lines are usually parallel, and introducing an angle between the balanced transmission lines can cause unwanted radiation patterns. Balanced transmission lines on circuits packaged using conventional side-by-side coaxial connectors usually diverge near the package wall to accommodate the wider pin spacing (typically about 11 mm), which alters the characteristics of the balanced transmission lines.

Package launches according to embodiments of the present invention can provide pins 2 mm apart, and in another embodiment, 3 mm apart. A pin spacing of about 3 mm (±10%) is particularly desirable for connecting to balanced high-frequency circuits and devices because it allows connecting the pins to parallel, balanced transmission lines, thus maintaining superior transmission characteristics at high frequencies. Alternatively, a 5 mm spacing or a 7 mm pin spacing is provided by other embodiments of the present invention.

The adaptor assembly 130 can be used to connect a balanced test cable to an electronic device with conventional differential package launches, to connect an electronic device having a package launch with a connector interface according to an embodiment of the present invention to a conventional VNA, or to use a balanced test cable to perform a two-port measurement (or a four-port measurement with two balanced test cables and two adaptors), for example. The part of a connector pair with the nut is typically the male part; however, adaptor assemblies are alternatively male-male, male-female, female-male, or female-female, and the differential connector interface 136 of the adaptor assembly 130 is alternatively threaded.

Figure 3B:
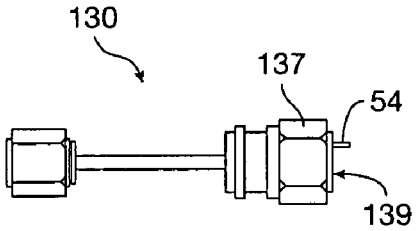
FIG. 3B shows the adaptor assembly of FIG. 3A with the slidable nut retracted.

FIG. 3B shows the adaptor assembly 130 of FIG. 3A with the slidable nut 137 retracted. Retracting the slidable nut 137 exposes the pin 54 and the face 139 of the connector interface. This allows an operator to align the pin 54 to a mating hole or other alignment feature as the face 139 of the connector interface is aligned to a mating connector interface. The slidable nut 137 is then slid forward (extended) to engage threads on the mating connector interface. This avoids the nut from obscuring the operator's view when aligning the pin to its mating hole.

Figure 3C:
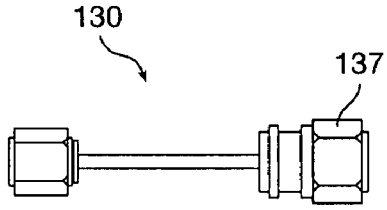
FIG. 3C shows the adaptor assembly of FIG. 3A with the slidable nut extended.

FIG. 3C shows the adaptor assembly 130 of FIG. 3A with the slidable nut 137 extended. Once the connector interface is aligned to its mating interface, the nut is slid forward (extended) to engage mating threads and secure the connector interfaces to each other.

Figure 3D:
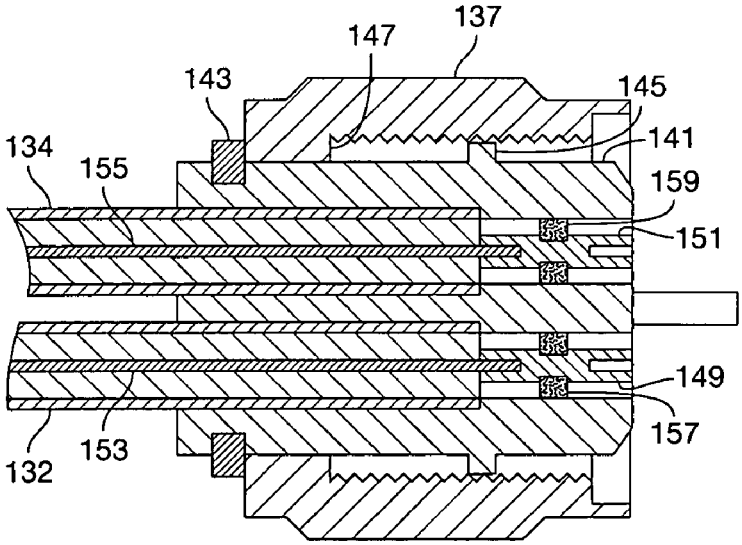
FIG. 3D is a cross section of a portion of the adaptor assembly of FIG. 3A.

FIG. 3D is a cross section of a portion of the adaptor assembly of FIG. 3A. The slidable nut 137 is captivated on a connector body 141 with a C-ring 143. The C-ring 143 forms a back stop and a ridge 145 of the connector body 141 forms a forward stop that a foot 147 of the slidable nut 137 slides between. Female-female center pins 149, 151 adapt the center conductors 153, 155 of the coaxial cables 132, 134 to a female-type connector interface. The center pins 149, 151 are held in the connector body 141 with dielectric standoffs 157, 159.

In some embodiments, the dimensions of the coaxial cable center conductors are suitable for directly connecting them to a mating connector interface (see, e.g., FIG. 1B). In other embodiments, it is desirable to provide a transition from the dimensions of the coaxial cable to a connector interface having more suitable dimensions for a particular connector interface standard. Similarly, the center conductors of coaxial cables are often relatively soft copper or silver-plated copper. This allows convenient bending of the cable, but the copper center conductors might not withstand the repeated connecting and disconnecting that arises in some applications, such a microwave component testing.

Figure 4A:
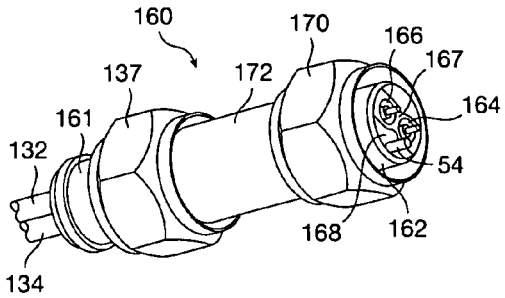
FIG. 4A is an isometric view of an adaptor connected to a connector body according to an embodiment of the invention.

FIG. 4A is an isometric view of an adaptor 160 connected to a connector body 161 according to an embodiment of the invention. The adaptor adapts two coaxial cables 132, 134 to a connector interface 162. Alternatively, the adaptor adapts a balanced cable having to coaxial cables to a connector interface (see FIG. 1C). The first slidable nut 137 slides relative to the connector body 161, and a second slidable nut 170 slides relative to an adaptor barrel 172.

The connector interface 162 includes two male-type coaxial structures 164, 166 and a pin 54. A raised ground plane 167 surrounds the coaxial structures 164, 166. The raised ground plane 167 is essentially a mesa-type feature that extends a selected height above the field 168 of the connector interface 162. The selected height is typically about 0.08 mm to about 0.5 mm. The raised ground plane contacts the face of a mating connector, either on a flat face on at another raised ground plane area so that the ground-to-ground electrical coupling occurs close to the coaxial structures, which in turn provides superior transmission characteristics.

Figure 4B:
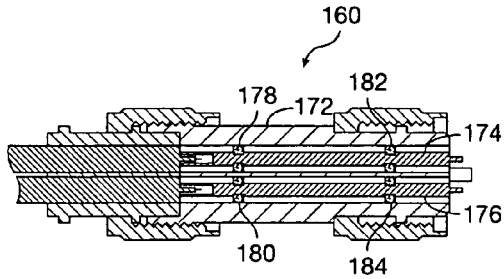
FIG. 4B shows a cross section of the adaptor of FIG. 4A.

FIG. 4B shows a cross section of the adaptor 160 of FIG. 4A. The adaptor 160 includes two female-to-male center pins 174, 176 disposed in the adaptor barrel 172 with dielectric standoffs 178, 180, 182, 184. In a particular embodiment, the center pins 174, 176 are made of metal that is harder than the center conductor material (typically copper or silver-plated copper) of the coaxial cables. This provides a more rugged connector interface capable of being connected and disconnected more times without significant degradation of transmission characteristics. In a particular embodiment, the center pins are made from a beryllium-copper alloy and are gold plated. Alternatively, the center pins are made from an iron alloy, such as stainless steel, and are plated or unplated.

In a further embodiment, the adaptor transitions from the dimensions of the coaxial cable to the dimensions of a connector standard. For example, semi-rigid coaxial cable is often manufactured so that the diameter of the center conductor is close to the diameter of a center pin of a connector standard. A small change in diameter from the center conductor to the center pin might be acceptable in some applications, but unacceptable in others. Using an adaptor that provides a transition from coaxial cable dimensions to connector interface dimensions improves transmission characteristics from the end of the cable to the device that the cable is attached to. Similarly, use of an adaptor that provides a transition from coaxial cable dimensions to connector interface dimensions allows greater design freedom in selecting what type of coaxial cable to use in a particular application (i.e., with a particular connector interface standard).

Figure 5A:
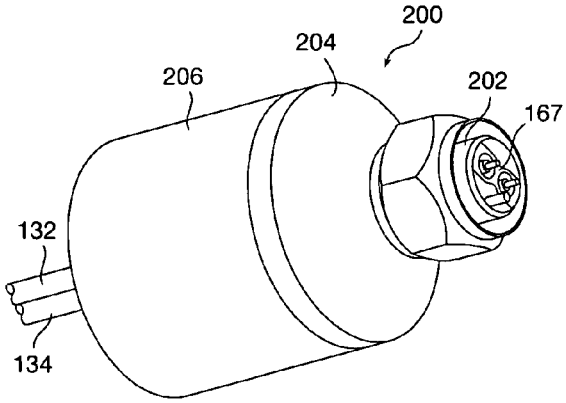
FIG. 5A is an isometric view of an adaptor according to another embodiment of the invention.

FIG. 5A is an isometric view of an adaptor 200 according to another embodiment of the invention. The adaptor 200 adapts two coaxial cables 132, 134 to a connector interface 202. Alternatively, the adaptor adapts a balanced cable having two coaxial cables to a connector interface (see FIG. 1C). The adaptor 200 includes a base 204 and a shell 206 that provide a larger grasping surface for manipulating the adaptor 200. The shell 206 also protects where the coaxial cables are connected to the base 204 (see FIG. 5B). The connector interface 202 includes a raised ground plane 167.

Figure 5B:
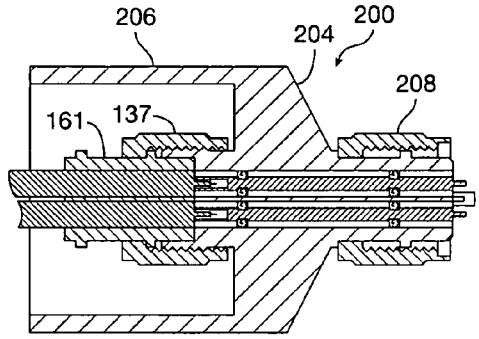
FIG. 5B is a simplified cross section of the adaptor of FIG. 5A.

FIG. 5B is a simplified cross section of the adaptor 200 of FIG. 5A. The shell 206 surrounds a connector body 161 and first slidable nut 137. The shell 206 and base 204 of the adaptor provide a more rugged assembly by providing a large-diameter exterior for an operator to grasp when tightening or loosening the second sliding nut 208.

Figure 6A:
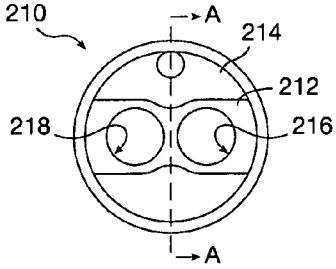
FIG. 6A is a front view of a connector body according to an embodiment of the invention.

FIG. 6A is a front view of a connector body 210 according to an embodiment of the invention. A raised ground plane portion 212 of the face of the connector body 210 extends a selected height above the field 214 of the connector body 210. The raised ground plane portion is in the shape of a figure-8 or hourglass, which facilitates machining the raised ground plane portion because it is not separated between the coaxial outer conductors 216, 218. The raised ground plane portion 212 increases the pressure between mating connectors (at a given force between the mating connectors) around the coaxial outer conductors 216, 218, improving the ground continuity and hence the transmission characteristics.

Figure 6B:
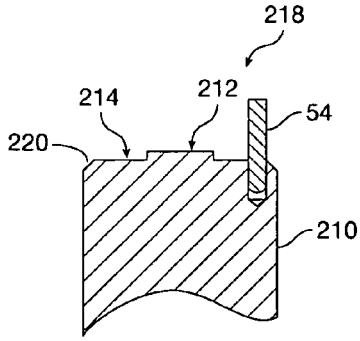
FIG. 6B is a cross section taken along A—A of FIG. 6A.

FIG. 6B is a cross section taken along A—A of FIG. 6A. The raised ground plane portion 212 is between about 0.08 mm and about 0.5 mm above the field 214 of the connector face 218. A chamfer 220 is formed on the rim of the connector body 210 to facilitate alignment and reduce burring during use. The pin 54 is fitted to a hole drilled in the connector body 210.

Figure 7:
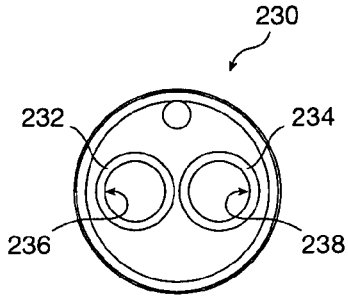
FIG. 7 is a front view of a connector body according to another embodiment of the invention.

FIG. 7 is a front view of a connector body 230 according to another embodiment of the invention. Separated raised ground plane portions 232, 234 surround coaxial outer conductors 236, 238. Raised ground plane portions are formed using a variety of techniques, such as milling, etching, abrasive blasting, and electronic discharge machining.

Figure 8:
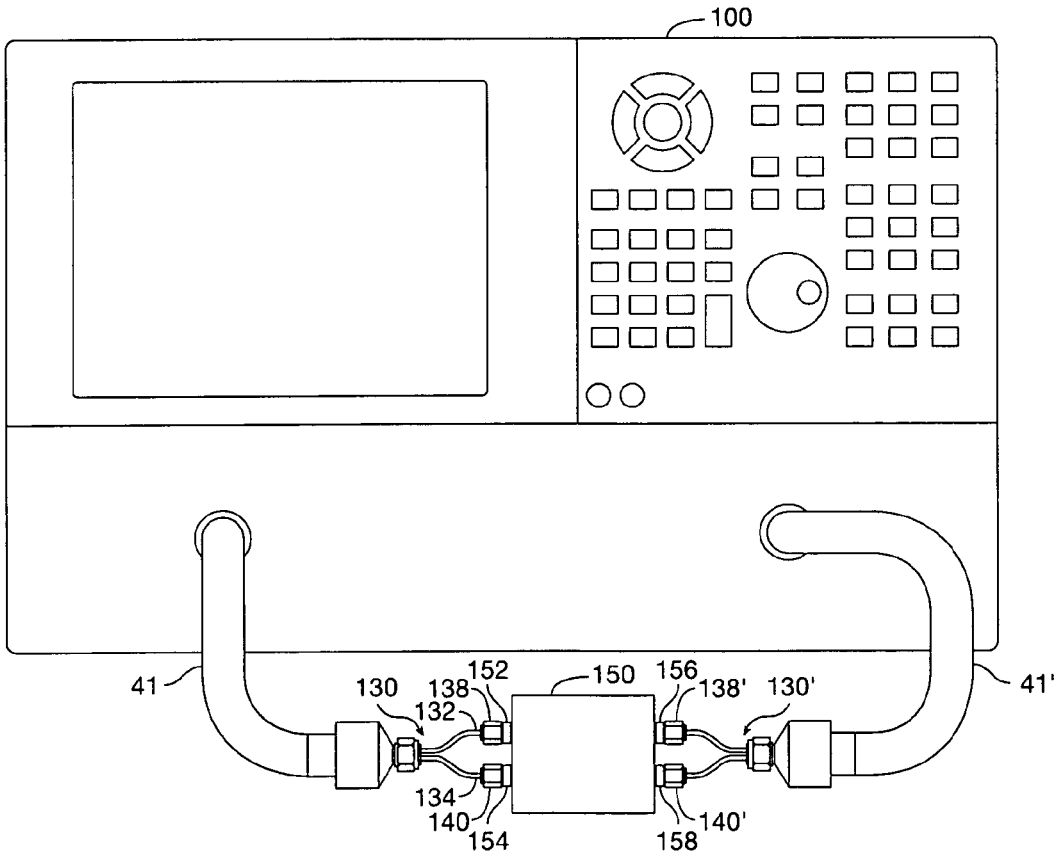
FIG. 8 shows adaptor assemblies illustrated in FIG. 3A connecting an electronic device having conventional package feedthroughs to a balanced vector network analyzer.

FIG. 8 shows adaptor assemblies 130, 130' illustrated in FIG. 3A connecting an electronic device 150 having conventional package feedthroughs 152, 154, 156, 158 to a balanced VNA 100. The adaptor assembly 130 separates the two coaxial transmission paths from a balanced cable 41 into two coaxial transmission lines 132, 134. These separated coaxial transmission lines are connected to conventional coaxial package feedthroughs 152, 154 with conventional coaxial cable ends 138, 140 of the adaptor assembly 130. Another adaptor assembly 130' similarly connects conventional coaxial package feedthroughs 156, 158 with conventional coaxial cable ends 138', 140' to a second balanced cable 41'. This configuration may be used to perform balanced two-port measurements on a conventional differential two-port electronic device, or to perform four-port measurements on a four-port electronic device, using a balanced VNA and balanced cables.

A balanced cable with a cable end incorporating a connector interface constructed according to an embodiment of the present invention provides desirable advantages over conventional cables used with VNA systems because of the stability of the balanced cable. Most of the transmission line length between the VNA 100 and the electronic device 150 is a balanced test cable 41, which maintains balance through the connector interface and is less likely to introduce measurement error due to movement of the test cables, compared to conventional four-cable systems or balanced cables with conventional cable ends.

While the preferred embodiments of the present invention have been illustrated in detail, it should be apparent that modifications and adaptations to these embodiments may occur to one skilled in the art without departing from the scope of the present invention as set forth in the following claims.

What is claimed is:

1. An adaptor comprising:

a connector interface including a first coaxial structure having a first center pin configured to be coupled to a first center conductor of a first coaxial transmission line, and a second coaxial structure having a second center pin configured to be coupled to a second center conductor of a second coaxial transmission line; and a slidable nut surrounding the first coaxial structure and the second coaxial structure.

2. The adaptor of claim 1 wherein at least one of the first center pin and the second center pin is a female-to-male type center pin.

3. The adaptor of claim 1 wherein the first coaxial transmission line and the second coaxial transmission line are each incorporated in a mating connector interface.

4. An adaptor comprising:

a connector interface including a first coaxial structure having a first center pin configured to be coupled to a first center conductor of a first coaxial transmission line, and a second coaxial structure having a second center pin configured to be coupled to a second center conductor of a second coaxial transmission line;

a nut surrounding the first coaxial structure and the second coaxial structure, a face having a raised ground plane portion surrounding at least one of the first coaxial structure and the second coaxial structure, and a field portion.

5. The adaptor of claim 4 wherein the raised ground plane portion is raised between about 0.08 mm and 0.5 mm above the field portion of the face.

6. The adaptor of claim 4 wherein the raised ground plane portion surrounds each of the first coaxial structure and the second coaxial structure.

7. An adaptor comprising:

a connector interface including a first coaxial structure having a first center pin configured to be coupled to a first center conductor of a first coaxial transmission line, and a second coaxial structure having a second center pin configured to be coupled to a second center conductor of a second coaxial transmission line; and a nut surrounding the first coaxial structure and the second coaxial structure wherein at least one of the first center pin and the second center pin is a female-to-female type center pin.

8. An adaptor comprising:

a connector interface including a first coaxial structure having a first center pin configured to be coupled to a first center conductor of a first coaxial transmission line, and a second coaxial structure having a second center pin configured to be coupled to a second center conductor of a second coaxial transmission line; and a nut surrounding the first coaxial structure and the second coaxial structure wherein the first center conductor is made of a first material and the first center pin is made of a second material, the second material being harder than the first material.

9. An adaptor comprising:

a connector interface including a first coaxial structure having a first center pin configured to be coupled to a first center conductor of a first coaxial transmission line, and a second coaxial structure having a second center pin configured to be coupled to a second center conductor of a second coaxial transmission line;

a nut surrounding the first coaxial structure and the second coaxial structure and a connector body coupled to the adaptor with a second nut, each of the first coaxial transmission line and the second coaxial transmission line extending through the connector body to be electrically coupled to the adaptor.

10. The adaptor of claim 9 wherein the second nut is a second slidable nut.

11. The adaptor of claim 9 further comprising a shell surrounding the second nut.

12. A connector interface comprising:

a face having a raised ground plane portion;

a first coaxial structure extending from the face;

a second coaxial structure extending from the face and being essentially parallel to the first coaxial structure, both the first coaxial structure and the second coaxial structure being disposed within a barrel; and an alignment feature configured to align the face to a mating connector interface.

13. A connector interface comprising:

a face;

a slidable nut circumscribing the face;

a first coaxial structure extending from the face;

a second coaxial structure extending from the face and being essentially parallel to the first coaxial structure; and an alignment feature configured to align the face to a mating connector interface.

14. An adaptor comprising:

a connector interface including a first coaxial structure having a first center pin configured to be coupled to a first center conductor of a first coaxial transmission line, a second coaxial structure having a second center pin configured to be coupled to a second center conductor of a second coaxial transmission line;

a nut surrounding the first coaxial structure and the second coaxial structure wherein the first coaxial structure extends from the connector interface in a direction, and the second coaxial structure extends from the connector interface in the direction.

15. The adaptor of claim 14 wherein the first coaxial structure is separated from the second coaxial structure on the connector interface.

* * * * *